US011251535B2

(12) United States Patent
Nakanishi et al.

(10) Patent No.: US 11,251,535 B2
(45) Date of Patent: Feb. 15, 2022

(54) ANTENNA DEVICE

(71) Applicant: Mitsubishi Electric Corporation, Tokyo (JP)

(72) Inventors: Takayuki Nakanishi, Tokyo (JP); Yoshio Inasawa, Tokyo (JP); Takeshi Yamamoto, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 405 days.

(21) Appl. No.: 16/470,621

(22) PCT Filed: Jan. 30, 2017

(86) PCT No.: PCT/JP2017/003161
§ 371 (c)(1),
(2) Date: Jun. 18, 2019

(87) PCT Pub. No.: WO2018/138910
PCT Pub. Date: Aug. 2, 2018

(65) Prior Publication Data

US 2019/0341699 A1 Nov. 7, 2019

(51) Int. Cl.

| | |
|---|---|
| ***H01Q 15/14*** | (2006.01) |
| ***H01Q 1/38*** | (2006.01) |
| ***H01Q 3/26*** | (2006.01) |
| ***H01Q 21/06*** | (2006.01) |

(52) U.S. Cl.
CPC ..... *H01Q 15/14* (2013.01); *H01Q 1/38* (2013.01); *H01Q 3/26* (2013.01); *H01Q 21/06* (2013.01)

(58) Field of Classification Search
CPC ..... H01Q 15/14; H01Q 1/38; H01Q 3/26; H01Q 21/06
USPC ..... 343/907
See application file for complete search history.

(56) References Cited

U.S. PATENT DOCUMENTS

2010/0039343 A1* 2/2010 Uno ..... H01Q 3/24 343/818

FOREIGN PATENT DOCUMENTS

| | | | |
|---|---|---|---|
| JP | 2002-26642 | A | 1/2002 |
| JP | 3695973 | B2 | 9/2005 |

OTHER PUBLICATIONS

Office Action issued in corresponding German Patent Application No. 11 2017 006 377.9 dated Apr. 20, 2020.

* cited by examiner

*Primary Examiner* — Andrea Lindgren Baltzell
(74) *Attorney, Agent, or Firm* — Birch, Stewart, Kolasch & Birch, LLP

(57) ABSTRACT

Out of a plurality of receiving element antennas (2*a*) in a receiving antenna (2), with respect to one receiving element antenna ($\mathbf{2}a_{center}$) as the center, the remaining receiving element antennas ($\mathbf{2}a_n$) are arranged symmetrically, and with distance from the one receiving element antenna ($\mathbf{2}a_{center}$), each of the remaining receiving element antennas ($\mathbf{2}a_n$) is arranged to have a longer distance ($L_n$) to a position orthogonal to a straight line (A) passing through a position at which each of one or more transmitting element antennas (1*a*) is arranged.

13 Claims, 7 Drawing Sheets

ANTENNA DEVICE

TECHNICAL FIELD

The present invention relates to an antenna device including a transmitting array antenna and a receiving array antenna.

BACKGROUND ART

An antenna device including a transmitting antenna and a receiving antenna is disclosed in, for example, following Patent Literature 1.

In the antenna device disclosed in Patent Literature 1, gain in a forward direction of a radio wave emitted from the transmitting antenna is increased by operating the receiving antenna as a reflector as seen from the transmitting antenna. The forward direction is a 0 degree direction on a front surface of the transmitting antenna.

CITATION LIST

Patent Literatures

Patent Literature 1: JP 2002-26642 A

SUMMARY OF INVENTION

Technical Problem

Since the conventional antenna device is configured as described above, the gain in the forward direction of the radio wave emitted from the transmitting antenna may be increased. However, there is a problem that the gain in a wide angle direction an angle of which is deviated from the 0 degree direction on the front surface decreases.

The present invention is achieved to solve the above-described problem, and an object thereof is to obtain an antenna device capable of increasing gain in a wide angle direction of a radio wave emitted from a transmitting antenna.

Solution to Problem

An antenna device according to the present invention is provided with: a transmitting antenna to transmit a radio wave to space; and a receiving antenna arranged, out of front and rear surfaces of the transmitting antenna, on a side of the rear surface where an observation target is not present, to receive a reflected wave of the radio wave reflected back by the observation target, wherein one or more transmitting element antennas in the transmitting antenna are arranged side by side on a straight line, and out of a plurality of receiving element antennas in the receiving antenna, with respect to one receiving element antenna as a center, remaining receiving element antennas are symmetrically arranged, and with distance from the one receiving element antenna, each of the remaining receiving element antennas is arranged to have a longer distance to a position orthogonal to the straight line passing through a position at which each of the one or more transmitting element antennas is arranged.

Advantageous Effects of Invention

According to the present invention, it is configured so that, out of a plurality of receiving element antennas in a receiving antenna, with respect to one receiving element antenna as the center, the remaining receiving element antennas are arranged symmetrically, and with distance from the one receiving element antenna, each of the remaining receiving element antennas is arranged to have a longer distance to a position orthogonal to a straight line passing through a position at which each of the one or more transmitting element antennas is arranged, and therefore there is an effect capable of increasing gain in a wide angle direction of a radio wave emitted from a transmitting antenna.

DESCRIPTION OF EMBODIMENTS

A mode for carrying out the present invention is hereinafter described with reference to the attached drawings in order to describe the present invention in further detail.

First Embodiment

Figure 1:
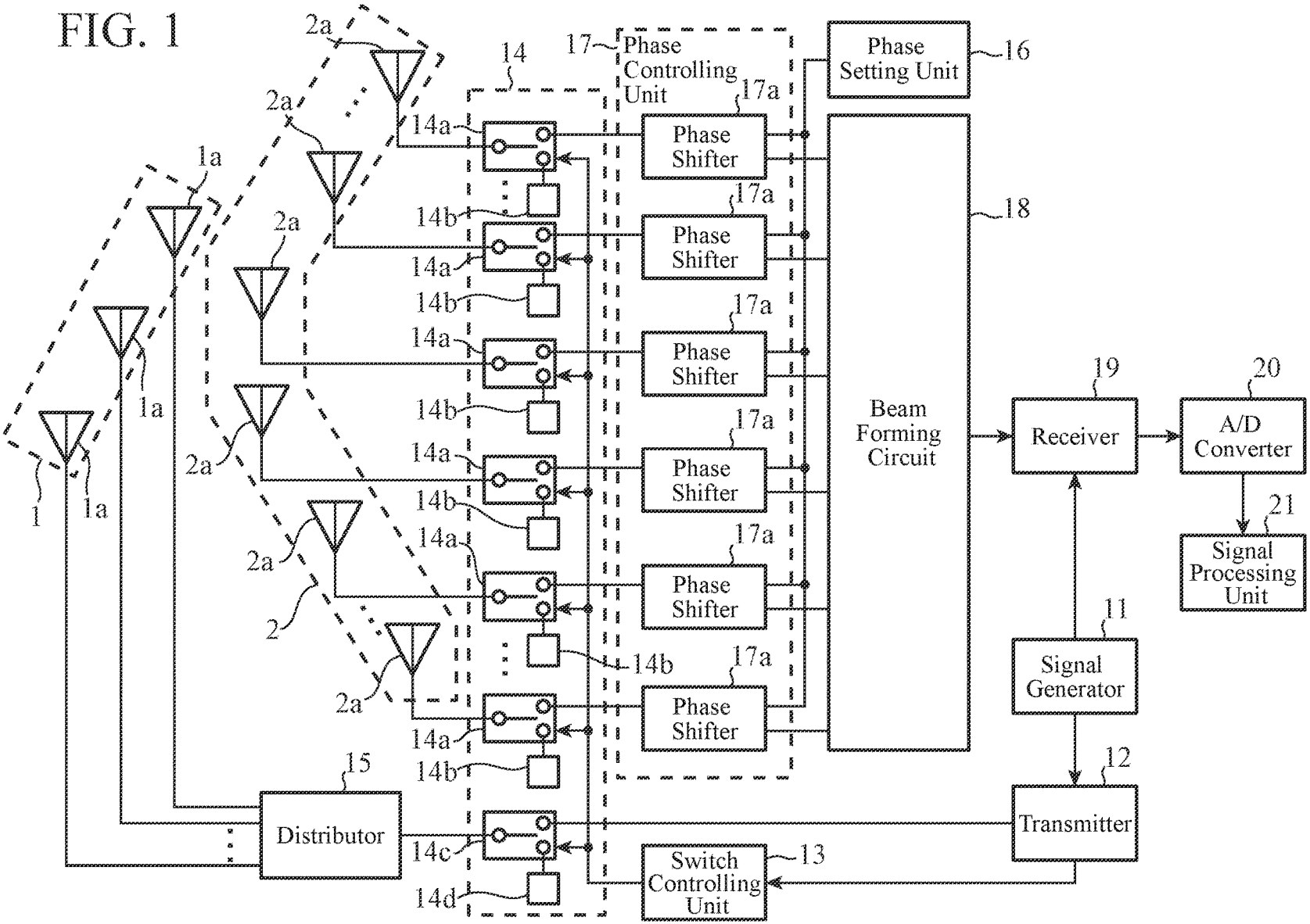
FIG. 1 is a configuration diagram illustrating an antenna device according to a first embodiment of the present invention.
Figure 2:
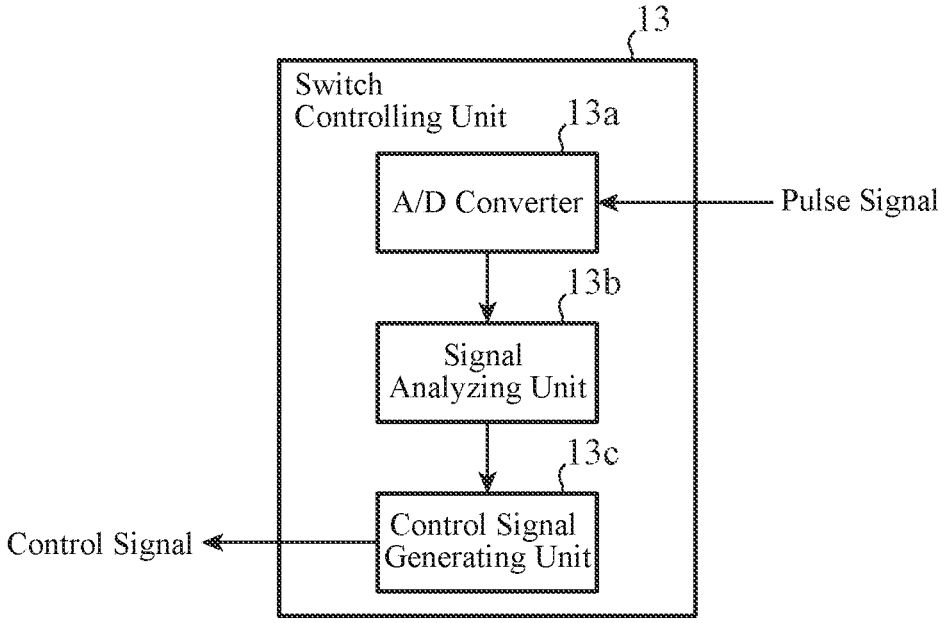
FIG. 2 is a configuration diagram illustrating a switch controlling unit 13 of the antenna device according to the first embodiment of the present invention.

FIG. 1 is a configuration diagram illustrating an antenna device according to a first embodiment of the present invention, and FIG. 2 is a configuration diagram illustrating a switch controlling unit 13 of the antenna device according to the first embodiment of the present invention.

Figure 3:
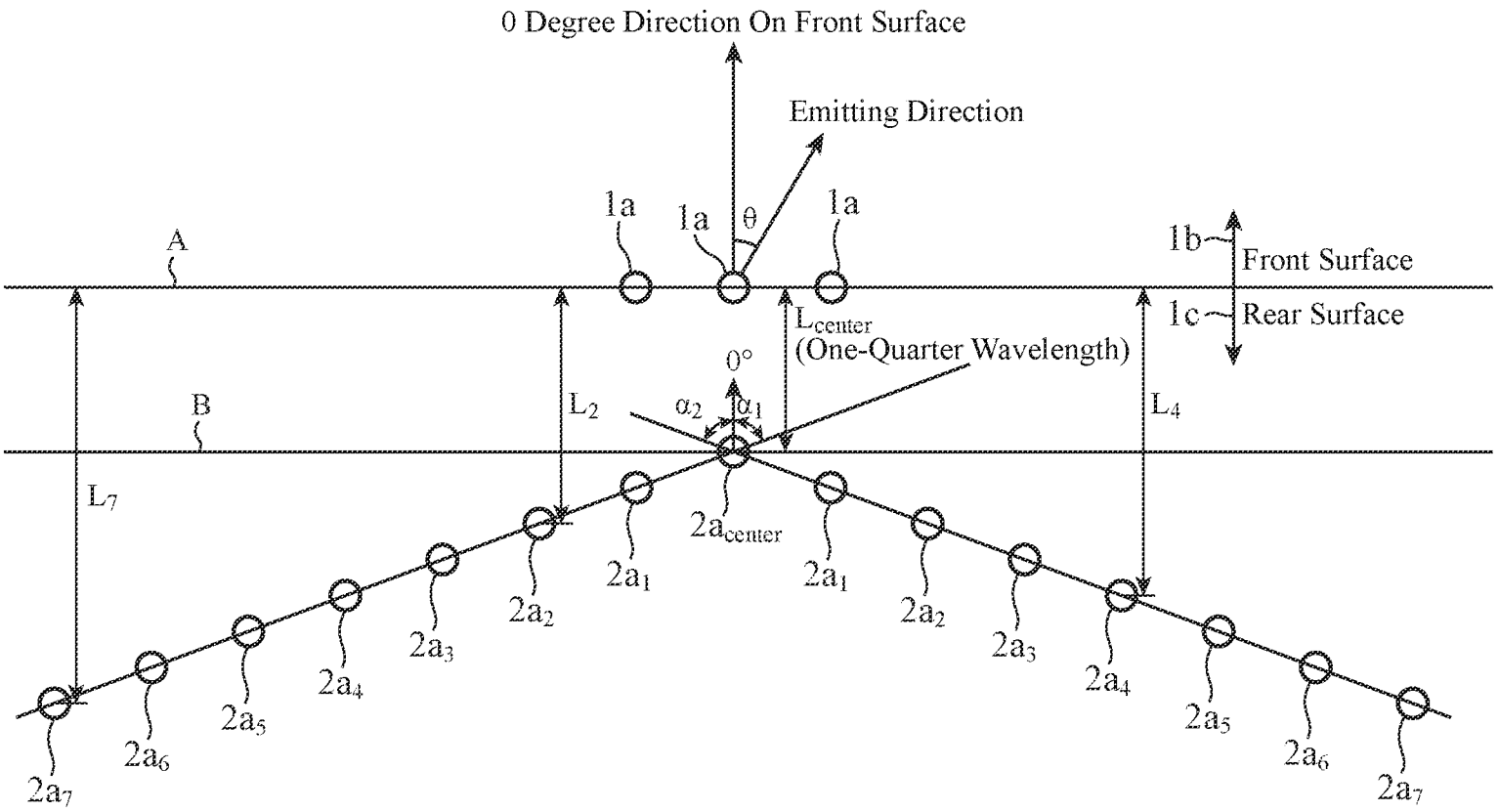
FIG. 3 is an illustrative view illustrating arrangement of a transmitting antenna 1 and a receiving antenna 2 in the antenna device in FIG. 1.

FIG. 3 is an illustrative view illustrating arrangement of a transmitting antenna 1 and a receiving antenna 2 in the antenna device in FIG. 1.

In FIGS. 1 to 3, the transmitting antenna 1 includes one or more transmitting element antennas 1*a* and emits a radio wave to space. When the transmitting antenna 1 includes two or more transmitting element antennas 1*a*, the transmitting antenna operates as an array antenna.

As illustrated in FIG. 3, the one or more transmitting element antennas 1*a* in the transmitting antenna 1 are dipole antennas arranged side by side on a straight line.

In an example in FIG. 3, the transmitting antenna 1 includes three transmitting element antennas 1*a*, but it is sufficient that the number of transmitting element antennas 1*a* is smaller than the number of receiving element antennas 2*a* included in the receiving antenna 2, and the number of transmitting element antenna 1*a* may be one. When the number of transmitting element antennas 1*a* is larger than the number of receiving element antennas 2*a*, reflection efficiency when the receiving antenna 2 is operated as a reflector as seen from the transmitting antenna 1 is deteriorated.

In FIG. 3, out of front and rear surfaces of the transmitting antenna 1, a side of the front surface where a target to be observed is present is represented by 1*b*, and a side of the rear surface where there is no target is represented by 1*c*.

The receiving antenna 2 is provided on the rear surface side 1*c* of the transmitting antenna 1 and is an array antenna including a plurality of receiving element antennas 2*a*.

After the radio wave is emitted from the transmitting antenna 1, the receiving antenna 2 receives a reflected wave of the radio wave reflected back by the target.

The plurality of receiving element antennas 2*a* in the receiving antenna 2 is dipole antennas each of which receives the reflected wave.

In the example in FIG. 3, the number of receiving element antennas 2*a* included in the receiving antenna 2 is 15, and among the receiving element antennas 2*a*, the receiving element antenna 2*a* arranged at the center is represented as a "receiving element antenna $\mathbf{2}a_{center}$".

Also, an nth (n=1, 2, . . . , 7) receiving element antenna 2*a* to the left of the receiving element antenna $\mathbf{2}a_{center}$ and an nth (n=1, 2, . . . , 7) receiving element antenna 2*a* to the right are each represented as a "receiving element antenna $\mathbf{2}a_n$".

Although FIG. 3 illustrates the example in which the number of receiving element antennas 2*a* is 15, it is sufficient that the number of receiving element antennas 2*a* is larger than the number of transmitting element antennas 1*a*, and the number of receiving element antennas 2*a* may be smaller than 15 or may be equal to or larger than 16.

In the first embodiment, with respect to the one receiving element antenna $\mathbf{2}a_{center}$, as the center, among the plurality of receiving element antennas 2*a*, the remaining receiving element antennas $\mathbf{2}a_n$ are arranged symmetrically. Also, with distance from the receiving element antenna $\mathbf{2}a_{center}$, each of the remaining receiving element antennas $\mathbf{2}a_n$ is arranged to have a longer distance Ln (n=1, 2, . . . , 7) to a position orthogonal to a straight line A passing through positions at which the three transmitting element antennas 1*a* are arranged.

Therefore, $L_{center}<L_1<L_2< \ldots <L_7$ is satisfied.

$L_{center}$ is a distance from the receiving element antenna $\mathbf{2}a_{center}$ to the position orthogonal to the straight line A and is a length of one-quarter of a wavelength of the radio wave emitted from the transmitting element antenna 1*a*.

Also, in the first embodiment, the plurality of receiving element antennas 2*a* is arranged at respective positions not overlapping with a direction of a beam formed by a beam forming circuit 18 to be described later.

In FIG. 3, an angle $\alpha_1$ of an arranging direction of a plurality of receiving element antennas $\mathbf{2}a_n$ arranged to the left of the receiving element antenna $\mathbf{2}a_{center}$ and the receiving element antenna $\mathbf{2}a_{center}$ is different from an angle θ of an emitting direction of the radio wave emitted from the transmitting antenna 1.

Also, an angle $\alpha_2$ of an arranging direction of a plurality of receiving element antennas $\mathbf{2}a_n$ arranged to the right of the receiving element antenna $\mathbf{2}a_{center}$ and the receiving element antenna $\mathbf{2}a_{center}$ is different from the angle θ of the emitting direction of the radio wave emitted from the transmitting antenna 1.

In the example in FIG. 3, $\theta<\alpha_1=\alpha_2$ is satisfied.

This makes it possible to avoid a situation in which the reflected wave to be received by a receiving element antenna $\mathbf{2}a_n$ at a position far from the receiving element antenna $\mathbf{2}a_{center}$ is blocked by a receiving element antenna $\mathbf{2}a_n$ at a position close to the receiving element antenna $\mathbf{2}a_{center}$.

In FIG. 3, a distance $L_2$ regarding a second receiving element antenna $\mathbf{2}a_2$ to the left of the receiving element antenna $\mathbf{2}a_{center}$, a distance $L_4$ regarding a fourth receiving element antenna $\mathbf{2}a_4$ to the right, and a distance $L_7$ regarding a seventh receiving element antenna $\mathbf{2}a_7$ to the left are illustrated.

Among the second receiving element antenna 2*a*, the fourth receiving element antenna 2*a*, and the seventh receiving element antenna 2*a*, the closest receiving element antenna 2*a* to the receiving element antenna $\mathbf{2}a_{center}$ is the second receiving element antenna 2*a*, and the next closest receiving element antenna 2*a* is the fourth receiving element antenna 2*a*. The farthest receiving element antenna 2*a* is the seventh receiving element antenna 2*a*.

Therefore, between the second receiving element antenna 2*a*, the fourth receiving element antenna 2*a*, and the seventh receiving element antenna 2*a*, a relationship of $L_2<L_4<L_7$ is satisfied.

A signal generator 11 generates a transmission signal of a frequency f, for example, and generates a pulse signal by pulse-modulating the transmission signal.

The signal generator 11 outputs the generated pulse signal to a transmitter 12, and outputs a local oscillation signal having the same frequency as that of the transmission signal to a receiver 19.

The transmitter 12 outputs the pulse signal output from the signal generator 11 to a switching device 14 as the radio wave to be emitted from each of the transmitting element antennas 1*a* of the transmitting antenna 1, and outputs the pulse signal to the switch controlling unit 13.

The switch controlling unit 13 is provided with an A/D converter 13*a* which is an analog-digital converter, a signal analyzing unit 13*b*, and a control signal generating unit 13*c*.

In a period in which the pulse signal is output from the transmitter 12, the switch controlling unit 13 outputs a control signal indicating that the pulse signal is output to a distributor 15 and that the plurality of receiving element antennas 2*a* in the receiving antenna 2 is connected to respective terminators 14*b* to the switching device 14.

In a period in which the pulse signal is not output from the transmitter 12, the switch controlling unit 13 outputs a control signal indicating that the reflected waves received by the plurality of receiving element antennas 2*a* are output to respective phase shifters 17*a* of a phase controlling unit 17 and that the transmitting element antennas 1*a* are connected to a terminator 14*d* via the distributor 15 to the switching device 14.

The A/D converter 13*a* of the switch controlling unit 13 converts the output signal of the transmitter 12 from an analog signal to a digital signal.

When a signal level of the digital signal converted by the A/D converter 13*a* is equal to or higher than a threshold level, the signal analyzing unit 13*b* of the switch controlling unit 13 determines that it is currently in the period in which the pulse signal is output from the transmitter 12.

Also, when the signal level of the digital signal converted by the A/D converter 13*a* is lower than the threshold level, the signal analyzing unit 13*b* determines that it is currently in the period in which the pulse signal is not output from the transmitter 12.

When the signal analyzing unit 13*b* determines that it is in the period in which the pulse signal is output, the control signal generating unit 13*c* of the switch controlling unit 13 outputs a control signal S1 indicating that the pulse signal is output to the distributor 15 and that the plurality of receiving element antennas 2*a* is connected to the respective terminators 14*b* to the switching device 14.

When the signal analyzing unit 13*b* determines that it is in the period in which the pulse signal is not output, the control signal generating unit 13*c* outputs a control signal S2 indicating that the reflected waves received by the plurality of receiving element antenna 2*a* are output to the respective phase shifters 17*a* of the phase controlling unit 17 and that the transmitting element antennas 1*a* are connected to the terminator 14*d* via the distributor 15 to the switching device 14.

The switching device 14 is provided with switching switches 14*a* and 14*c* and the terminators 14*b* and 14*d*.

When receiving the control signal S1 from the control signal generating unit 13*c* of the switch controlling unit 13, the switching device 14 connects the transmitter 12 to the distributor 15 and connects the receiving element antennas 2*a* to the respective terminators 14*b*.

When receiving the control signal S2 from the control signal generating unit 13*c* of the switch controlling unit 13, the switching device 14 connects the receiving element antennas 2*a* to the respective phase shifters 17*a* and connects the distributor 15 to the terminator 14*d*.

When the control signal output from the control signal generating unit 13*c* is the control signal S1, the switching switches 14*a* of the switching device 14 connect the receiving element antennas 2*a* to the terminators 14*b*, and when the control signal is the control signal S2, the switching switches 14*a* connect the receiving element antennas 2*a* to the phase shifters 17*a*.

When the control signal output from the control signal generating unit 13*c* is the control signal S1, the switching switch 14*c* of the switching device 14 connects the transmitter 12 to the distributor 15, and when the control signal is the control signal S2, the switching switch 14*c* connects the distributor 15 to the terminator 14*d*.

The distributor 15 distributes the pulse signal passing through the switching switch 14*c* of the switching device 14 to the one or more transmitting element antennas 1*a*.

A phase setting unit 16 sets phases of the plurality of receiving element antennas 2*a* so that, when it is assumed that the plurality of receiving element antennas 2*a* is arranged on a straight line B, the straight line B passing through the position at which the receiving element antenna $2a_{center}$ is arranged and being parallel to the straight line A, the same phase as a phase φ set for each of the plurality of receiving element antennas 2*a* appears on the straight line B. The phase φ is a phase for forming a beam in a desired direction.

The phase controlling unit 17 is provided with the plurality of phase shifters 17*a*, and by using the plurality of phase shifters 17*a*, adjusts each of the phases of the reflected waves received by the plurality of receiving element antennas 2*a* to a corresponding one of the phases set by the phase setting unit 16.

The beam forming circuit 18 is a first beam forming circuit which combines the reflected waves the phases of which are adjusted by the plurality of phase shifters 17*a* of the phase controlling unit 17 to form the beam in the desired direction.

The receiver 19 receives the reflected wave combined by the beam forming circuit 18.

In addition, by using the local oscillation signal output from the signal generator 11, the receiver 19 converts a frequency of a reception signal of the received reflected wave, and outputs the reception signal after the frequency conversion.

The A/D converter 20 being an analog-digital converter converts the reception signal output from the receiver 19 from an analog signal to a digital signal and outputs the digital signal to the signal processing unit 21.

The signal processing unit 21 is formed of, for example, a semiconductor integrated circuit on which a central processing unit (CPU) is mounted, a one-chip microcomputer or the like.

The signal processing unit 21 performs a process of analyzing the digital signal output from the A/D converter 20 and calculating a distance to a target, a speed of the target, an orientation in which the target is present and the like.

The operation is next described.

In the first embodiment, since the receiving antenna 2 operates as the reflector as seen from the transmitting antenna 1, gain of the radio wave emitted from the transmitting antenna 1 to the front surface side 1*b* is increased.

In addition, in the first embodiment, in order to improve the reflection efficiency when the receiving antenna 2 is operated as the reflector, the receiving element antenna $2a_{center}$ is arranged at the position in which the distance $L_{center}$ from the receiving element antenna $2a_{center}$ to the straight line A is the length of one-quarter of the wavelength of the radio wave emitted from the transmitting element antenna 1*a*.

Note that, it is not necessary that the distance $L_{center}$ is fully coincident with the length of one-quarter of the wavelength of the radio wave, and it is sufficient that the distance is substantially the length of one-quarter wavelength.

Figure 4:
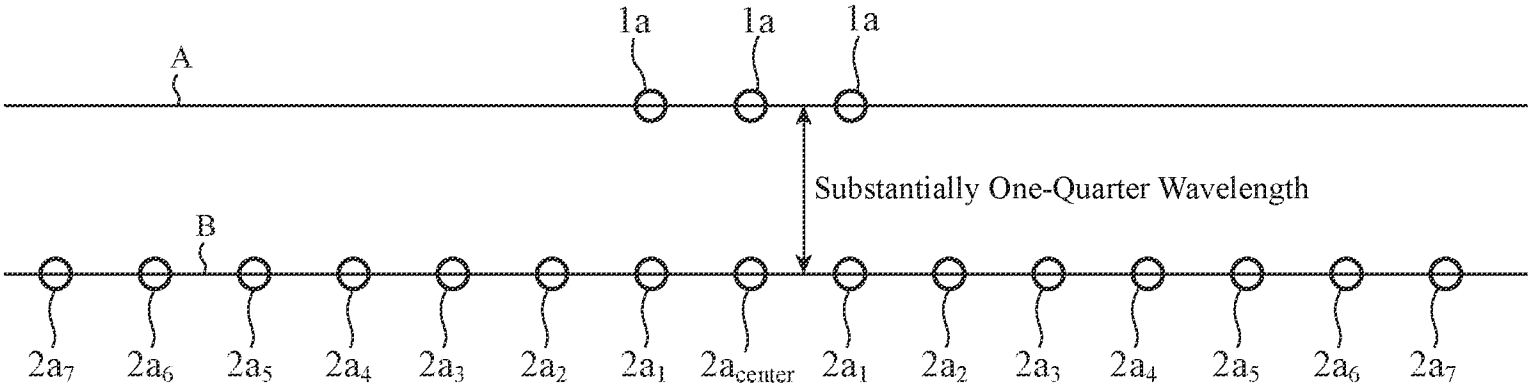
FIG. 4 is an illustrative view illustrating arrangement of the transmitting antenna 1 and the receiving antenna 2 when a plurality of receiving element antennas 2*a* is arranged on a straight line B illustrated in FIG. 3.

FIG. 4 is an illustrative view illustrating arrangement of the transmitting antenna 1 and the receiving antenna 2 when a plurality of receiving element antennas 2*a* is arranged on the straight line B illustrated in FIG. 3.

In the first embodiment, since the plurality of receiving element antennas 2*a* is arranged as illustrated in FIG. 3, it is possible to increase gain in a wide angle direction of the radio wave emitted from the transmitting antenna 1 as compared with a case where the plurality of receiving element antennas 2*a* is arranged as illustrated in FIG. 4. The wide angle direction means a direction an angle of which is deviated from the 0 degree direction on the front surface.

Figure 5:
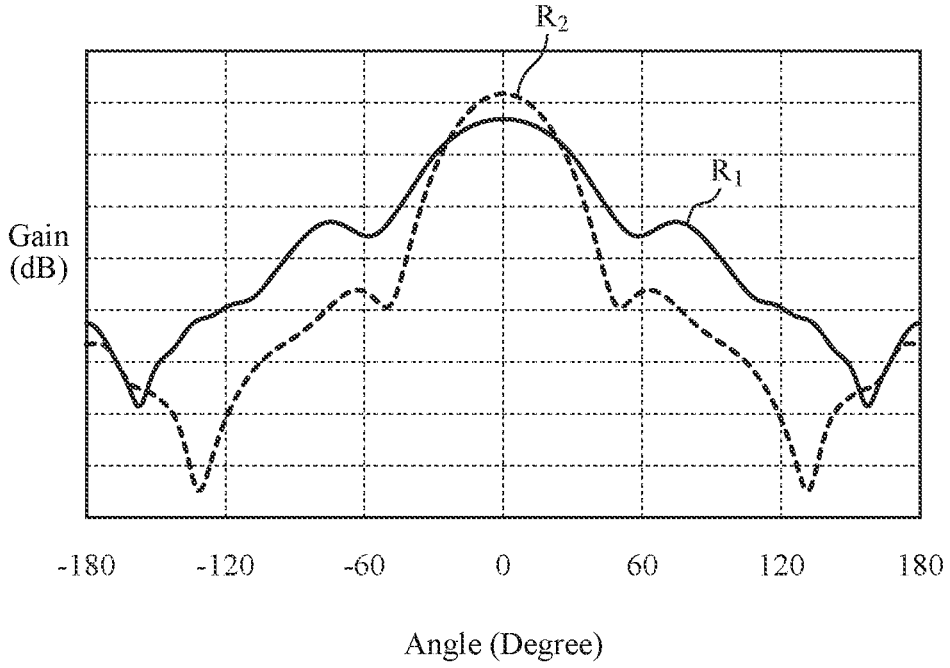
FIG. 5 is an illustrative view illustrating a simulation result of an emission pattern in the transmitting antenna 1.

Herein, FIG. 5 is an illustrative view illustrating a simulation result of an emission pattern in the transmitting antenna 1.

In FIG. 5, $R_1$ represents an emission pattern in the transmitting antenna 1 when the plurality of receiving element antennas 2*a* is arranged as illustrated in FIGS. 3, and $R_2$ represents an emission pattern in the transmitting antenna 1 when the plurality of receiving element antennas 2*a* is arranged as illustrated in FIG. 4.

As is apparent from a comparison between the emission pattern $R_1$ and the emission pattern $R_2$, the gain in the wide angle direction is higher when the plurality of receiving element antennas 2*a* is arranged as illustrated in FIG. 3, as compared with a case where the plurality of receiving element antennas 2*a* is arranged as illustrated in FIG. 4. This makes it possible to transmit the pulse signal which is the radio wave over a wide range.

By arranging the plurality of receiving element antennas 2*a* behind the transmitting antenna 1, an image antenna of the transmitting antenna 1 is generated behind the receiving antenna 2, and the emission pattern changes by combination of the transmitting antenna 1 and the image antenna. In a case of the first embodiment, the image antenna corresponding to the arrangement of the receiving antenna 2 and the transmitting antenna 1 are combined, and the gain in the wide angle direction is increased.

The signal generator 11 generates the transmission signal of the frequency f, for example, and generates the pulse signal by pulse-modulating the transmission signal.

When generating the pulse signal, the signal generator 11 outputs the pulse signal to the transmitter 12, and outputs the local oscillation signal having the same frequency as that of the transmission signal to the receiver 19.

When receiving the pulse signal from the signal generator 11, the transmitter 12 outputs the pulse signal to the switching device 14 as the radio wave to be emitted from each of the transmitting element antennas 1*a* of the transmitting antenna 1, and outputs the pulse signal to the switch controlling unit 13.

The A/D converter 13*a* of the switch controlling unit 13 converts the signal output from the transmitter 12 from the analog signal to the digital signal.

When receiving the digital signal from the A/D converter 13*a*, the signal analyzing unit 13*b* of the switch controlling unit 13 compares the signal level of the digital signal with the threshold level set in advance.

When the signal level of the digital signal is equal to or higher than the threshold level, the signal analyzing unit 13*b* determines that it is currently in the period in which the pulse signal is output from the transmitter 12.

When the signal level of the digital signal is lower than the threshold level, the signal analyzing unit 13*b* determines that it is currently in the period in which the pulse signal is not output from the transmitter 12.

When the signal analyzing unit 13*b* determines that it is in the period in which the pulse signal is output, the control signal generating unit 13*c* of the switch controlling unit 13 outputs the control signal S1 indicating that the pulse signal is output to the distributor 15 and that the plurality of receiving element antennas 2*a* is connected to the respective terminators 14*b* to the switching device 14.

When the signal analyzing unit 13*b* determines that it is in the period in which the pulse signal is not output, the control signal generating unit 13*c* outputs the control signal S2 indicating that the reflected waves received by the plurality of receiving element antennas 2*a* are output to the respective phase shifters 17*a* and that the transmitting element antennas 1*a* are connected to the terminator 14*d* via the distributor 15 to the switching device 14.

When receiving the control signal S1 from the control signal generating unit 13*c*, the switching switch 14*c* of the switching device 14 connects the transmitter 12 to the distributor 15.

As a result, the pulse signal output from the transmitter 12 passes through the switching switch 14*c* to be output to the distributor 15.

The distributor 15 distributes the pulse signal passing through the switching switch 14*c* of the switching device 14 to the three transmitting element antennas 1*a*.

As a result, the pulse signals being the radio waves are emitted from the three transmitting element antennas 1*a* to the space.

At that time, since the switching switches 14*a* of the switching device 14 connect the receiving element antennas 2*a* to the terminators 14*b* depending on the control signal S1 output from the control signal generating unit 13*c*, no reflected wave is received in a period in which the pulse signals are emitted from the three transmitting element antennas 1*a*. Therefore, reception of an unnecessary radio wave can be avoided.

When receiving the control signal S2 from the control signal generating unit 13*c*, the switching switch 14*c* of the switching device 14 connects the distributor 15 to the terminator 14*d*. As a result, no pulse signal is not emitted from the three transmitting element antennas 1*a* to the space.

At that time, the switching switches 14*a* of the switching device 14 connect the receiving element antennas 2*a* to the phase shifters 17*a* depending on the control signal S2 output from the control signal generating unit 13*c*.

As a result, the reflected waves received by the plurality of receiving element antennas 2*a* pass through the switching switches 14*a* and are output to the phase shifters 17*a* of the phase controlling unit 17.

The phase setting unit 16 sets the phases of the plurality of receiving element antennas 2*a* arranged as illustrated in FIG. 3 so that, when it is assumed that the plurality of receiving element antennas 2*a* is arranged as illustrated in FIG. 4, the same phase as the phase φ set for each of the plurality of receiving element antennas 2*a* appears on the straight line B illustrated in FIG. 3. The phase φ is a phase for forming a beam in a desired direction.

By using the plurality of phase shifters 17*a*, the phase controlling unit 17 adjusts each of the phases of the reflected waves received by the plurality of receiving element antennas 2*a* to a corresponding one of the phases set by the phase setting unit 16.

As a result, even when the plurality of receiving element antennas 2*a* is arranged as illustrated in FIG. 3, the emission pattern of the receiving antenna 3 is substantially similar to that in the case where the plurality of receiving element antennas 2*a* is arranged as illustrated in FIG. 4.

Note that, in the first embodiment, with distance from the receiving element antenna $2a_{center}$, each of the receiving element antennas $2a_n$ is arranged to have a longer distance $L_n$ to the straight line A, so that the reception of the unnecessary wave from ±180 degrees (in FIG. 3, lower side of the drawing) behind the receiving antenna 2 is suppressed.

Figure 6:
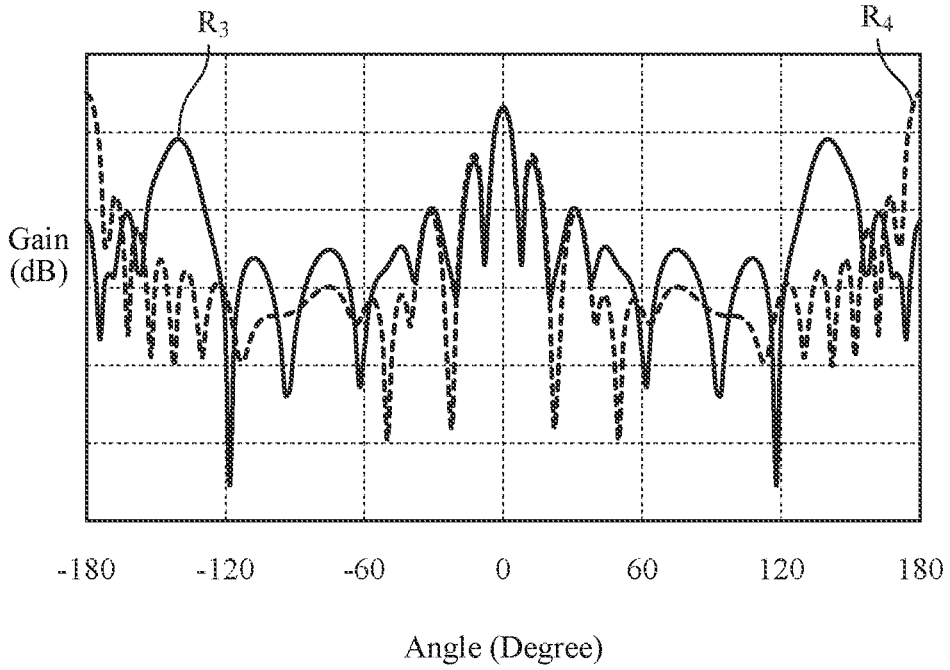
FIG. 6 is an illustrative view illustrating a simulation result of an emission pattern in the receiving antenna 2.

Herein, FIG. 6 is an illustrative view illustrating a simulation result of the emission pattern in the receiving antenna 2.

In FIG. 6, $R_3$ represents an emission pattern in the receiving antenna 2 when the plurality of receiving element antennas 2*a* is arranged as illustrated in FIGS. 3, and $R_4$ represents an emission pattern in the receiving antenna 2 when the plurality of receiving element antennas 2*a* is arranged as illustrated in FIG. 4. FIG. 6 illustrates an example in which a desired emitting direction of the radio wave is 0 degree.

As is apparent from a comparison between the emission pattern $R_3$ and the emission pattern $R_4$, the gain at the angle of ±180 degrees behind the receiving antenna 2 is lower when the plurality of receiving element antennas 2*a* is arranged as illustrated in FIG. 3, as compared with a case where the plurality of receiving element antennas 2*a* is arranged as illustrated in FIG. 4.

Therefore, in the first embodiment, the reception of the unnecessary wave from behind the receiving antenna 2 can be suppressed as compared with the case where the plurality of receiving element antennas 2*a* is arranged as illustrated in FIG. 4.

The phases of the radio waves coming from a forward direction and coming into the respective receiving element antennas 2*a* are set to be co-phase, so that the phases of the radio waves from behind are not in phase and the gain decreases. Therefore, by providing the phase setting unit 16, it is possible to suppress the reception of the unnecessary wave from behind.

The beam forming circuit 18 combines the reflected waves the phases of which are adjusted by the plurality of phase shifters 17*a* of the phase controlling unit 17 to form the beam in the desired direction.

The receiver 19 receives the reflected wave combined by the beam forming circuit 18, converts the frequency of the reception signal of the reflected wave using the local oscillation signal output from the signal generator 11, and outputs the reception signal after the frequency conversion to the A/D converter 20.

When receiving the reception signal from the receiver 19, the A/D converter 20 converts the reception signal from the analog signal to the digital signal and outputs the digital signal to the signal processing unit 21.

When receiving the digital signal from the A/D converter 20, the signal processing unit 21 analyzes the digital signal and calculates the distance to the target, the speed of the target, the orientation in which the target is present and the like.

Since a method of calculating the distance to the target, the speed of the target, the orientation in which the target is present and the like is a well-known technology, the detailed description thereof is omitted.

As is clear from the above description, according to the first embodiment, it is configured so that, with respect to the one receiving element antenna $2a_{center}$, as the center, among the plurality of receiving element antennas 2*a* in the receiving antenna 2, the remaining receiving element antennas $2a_n$ are arranged symmetrically, and with distance from the one receiving element antenna $2a_{center}$, each of the remaining receiving element antenna $2a_n$ is arranged to have a longer distance $L_n$ to the position orthogonal to the straight line A passing through the position at which each of the one or more transmitting element antennas 1*a* is arranged, and therefore there is an effect capable of increasing the gain in the wide angle direction of the radio wave emitted from the transmitting antenna 1.

Also, according to the first embodiment, the plurality of receiving element antennas 2*a* is arranged as illustrated in FIG. 3. When it is assumed that the plurality of receiving element antennas 2*a* is arranged on the straight line B, the straight line B passing through the position at which the receiving element antenna $2a_{center}$ is arranged and being parallel to the straight line A, the phase setting unit 16 sets the phases of the plurality of receiving element antennas 2*a* so that the same phase as the phase φ set for each of the plurality of receiving element antennas 2*a* appears on the straight line B.

Therefore, there is an effect that the reception of the unnecessary wave from behind the receiving antenna 2 can be suppressed, as compared with a case where the plurality of receiving element antennas 2*a* is arranged as illustrated in FIG. 4.

In the first embodiment, the example in which the transmitting element antennas 1*a* and the receiving element antennas 2*a* are dipole antennas is illustrated, but the transmitting element antennas 1*a* and the receiving element antennas 2*a* are not limited to the dipole antennas, and they may be monopole antennas, for example.

The similar effect can be obtained also when the transmitting element antennas 1*a* and the receiving element antennas 2*a* are the monopole antennas.

In the first embodiment, the example in which the plurality of receiving element antennas 2*a* is arranged as illustrated in FIG. 3 is illustrated, but it is sufficient that the plurality of receiving element antennas 2*a* are arranged at the respective positions not overlapping with the direction of the beam formed by the beam forming circuit 18.

Figure 7:
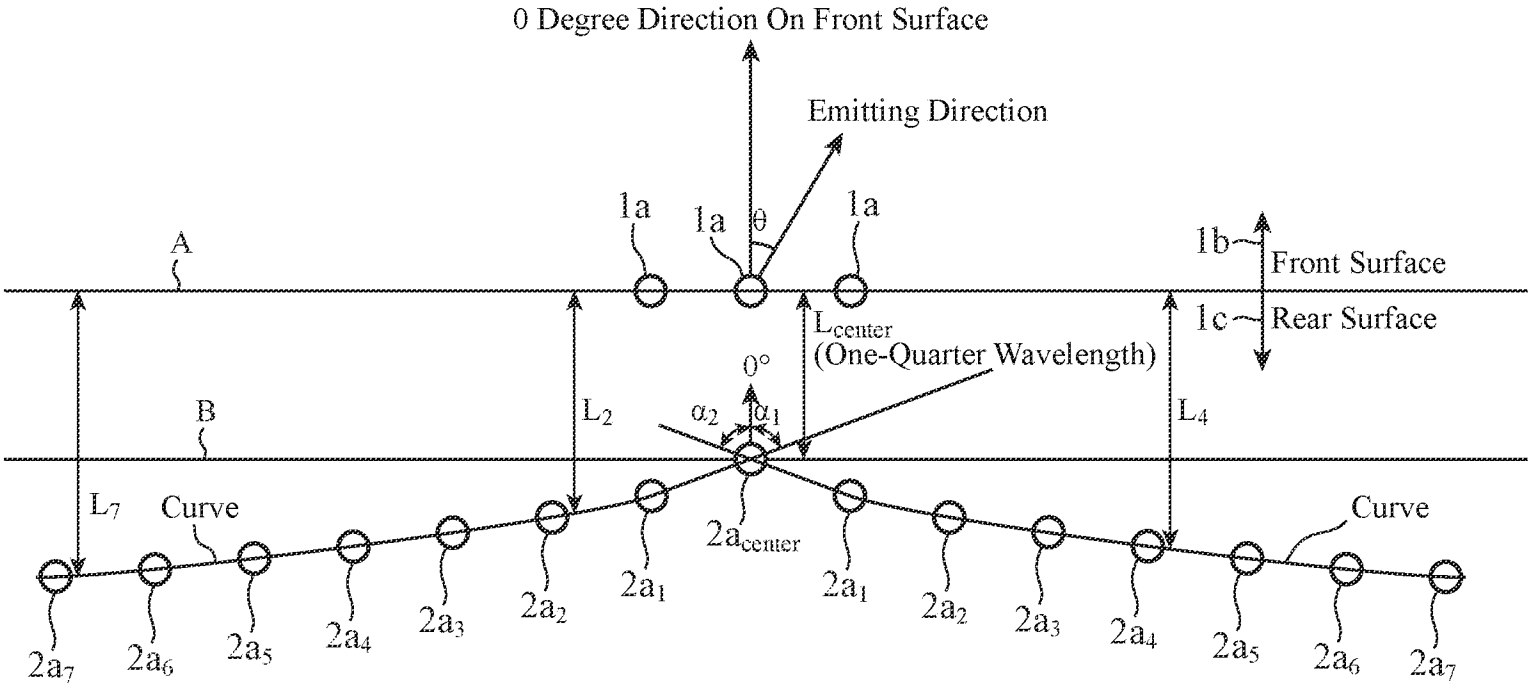
FIG. 7 is an illustrative view illustrating arrangement of the transmitting antenna 1 and the receiving antenna 2 in the antenna device in FIG. 1.

Therefore, a plurality of receiving element antennas $2a_n$ to the left of the receiving element antenna $2a_{center}$ and a plurality of receiving element antennas $2a_n$ to the right of the receiving element antenna $2a_{center}$ are not limited to those arranged on the straight lines, and may also be, for example, those arranged on curves as illustrated in FIG. 7.

FIG. 7 is an illustrative view illustrating the arrangement of the transmitting antenna 1 and the receiving antenna 2 in the antenna device in FIG. 1.

Second Embodiment

In the first embodiment, an example in which a beam forming circuit 18 combines a plurality of reflected waves after phase adjustment by a phase controlling unit 17 to form a beam in a desired direction is described.

In a second embodiment, an example in which each of the phases of digital signals output from A/D converters 31 being a plurality of analog-digital converters is adjusted, the plurality of digital signals after phase adjustment is combined, and a beam is formed in a desired direction is described.

Figure 8:
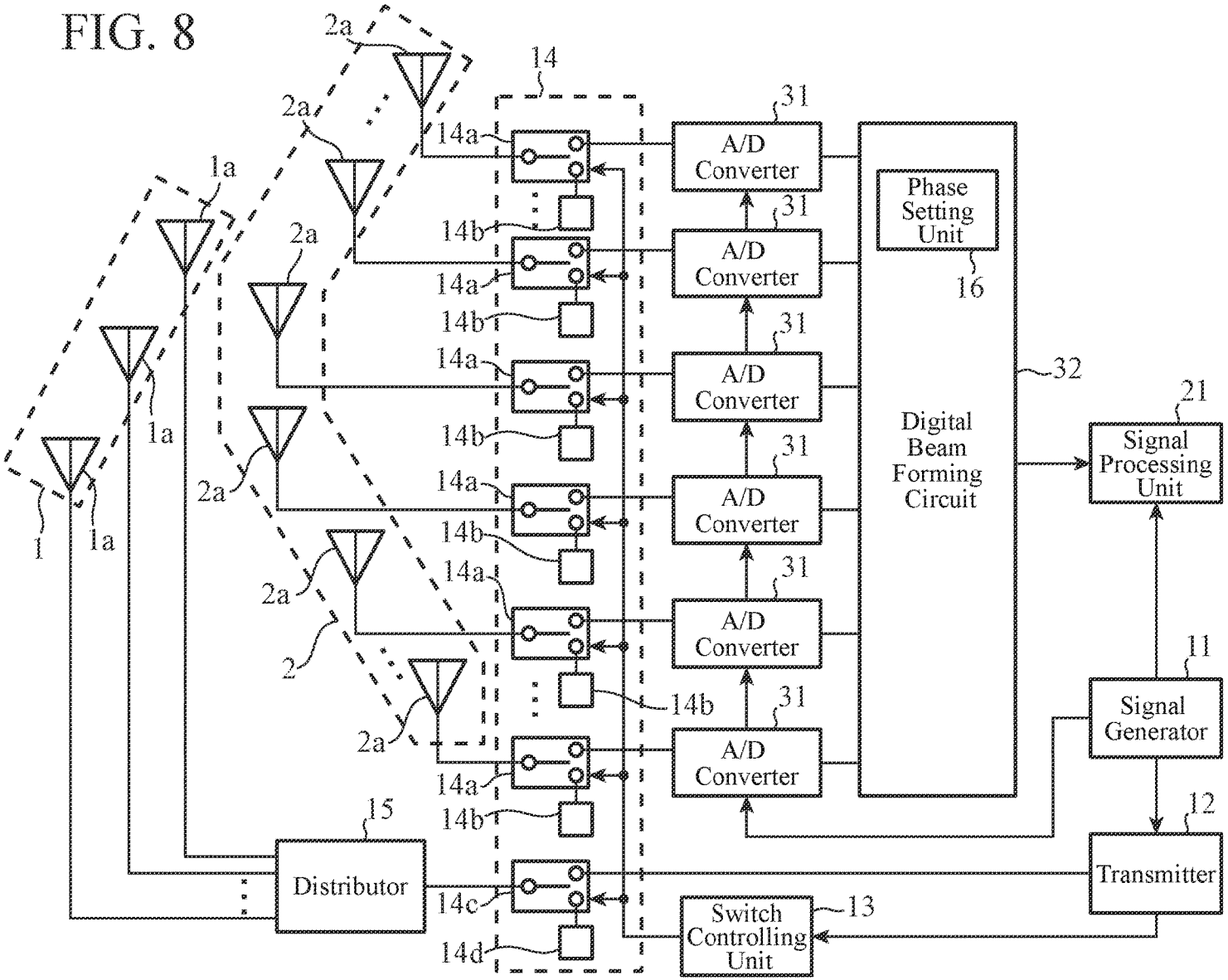
FIG. 8 is a configuration diagram illustrating an antenna device according to a second embodiment of the present invention.

FIG. 8 is a configuration diagram illustrating an antenna device according to the second embodiment of the present invention; in FIG. 8, the same reference signs as those in FIG. 1 represent the same or corresponding parts, so that the description thereof is omitted.

Each of the A/D converters 31 has a function of a receiver 19 in FIG. 1, and uses a local oscillation signal output from a signal generator 11 to convert a frequency of a reflected wave received by a corresponding receiving element antenna 2*a*.

Each of the A/D converters 31 also converts the reflected wave after the frequency conversion from an analog signal to a digital signal, and outputs the digital signal to a digital beam forming circuit 32.

The digital beam forming circuit 32 includes a phase setting unit 16, and is a second beam forming circuit which adjusts each of the phases of the digital signals output from the plurality of A/D converters 31 to a phase set by the phase setting unit 16, and combines the plurality of digital signals after the phase adjustment to form the beam in the desired direction.

The operation is next described.

It is different from the above-described first embodiment only in that the plurality of A/D converters 31 and the digital beam forming circuit 32 are provided in place of the phase controlling unit 17 and the beam forming circuit 18.

Therefore, arrangement of a transmitting antenna 1 and a receiving antenna 2 is similar to that in the above-described first embodiment, and a plurality of receiving element antennas 2*a* is arranged at respective positions not overlapping with the direction of the beam formed by the digital beam forming circuit 32.

When a control signal S2 is output from a switch controlling unit 13, the reflected waves received by the receiving element antennas 2*a* pass through respective switching switches 14*a*, so that the reflected waves are input to the A/D converters 31.

Each of the A/D converters 31 converts the frequency of the input reflected wave using the local oscillation signal output from the signal generator 11.

Each of the A/D converters 31 also converts the reflected wave after the frequency conversion from the analog signal to the digital signal, and outputs the digital signal to the digital beam forming circuit 32.

The digital beam forming circuit 32 includes the phase setting unit 16, and adjusts each of the phases of the digital signals output from the plurality of A/D converters 31 to the phase set by the phase setting unit 16.

The digital beam forming circuit 32 also combines the plurality of digital signals after the phase adjustment to form the beam in the desired direction.

According to the second embodiment, as in the above-described first embodiment, there is an effect that it is possible to increase gain in a wide angle direction of a radio wave emitted from the transmitting antenna 1 and suppress reception of an unnecessary wave from behind the receiving antenna 2, as compared with a case in which a plurality of receiving element antennas 2*a* is arranged as illustrated in FIG. 4.

Also, according to the second embodiment, since the digital beam forming circuit 32 performs a phase adjusting process by digital processing, it is possible to improve the accuracy of the phase adjusting process as compared with the first embodiment.

Note that, in the invention of the present application, the embodiments may be freely combined, any component of each embodiment may be modified, or any component may be omitted in each embodiment without departing from the scope of the invention.

INDUSTRIAL APPLICABILITY

The present invention is suitable for an antenna device including a transmitting array antenna and a receiving array antenna.

REFERENCE SIGNS LIST

1: Transmitting antenna, 1*a*: Transmitting element antenna, 1*b*: Front surface side, 1*c*: Rear surface side, 2: Receiving antenna, 2*a*, $2a_{center}$, $2a_n$: Receiving element antenna, 11: Signal generator, 12: Transmitter, 13: Switch controlling unit, 13*a*: A/D converter, 13*b*: Signal analyzing unit, 13*c*: Control signal generating unit, 14: Switching device, 14*a*, 14*c*: Switching switch, 14*b*, 14*d*: Terminator, 15: Distributor, 16: Phase setting unit, 17: Phase controlling unit, 17*a*: Phase shifter, 18: Beam forming circuit (first beam forming circuit), 19: Receiver, 20: A/D converter, 21: Signal processing unit, 31: A/D converter (analog-digital converter), 32: Digital beam forming circuit (second beam forming circuit).

The invention claimed is:

1. An antenna device comprising:

a transmitting antenna to emit a radio wave to space; and a receiving antenna arranged, out of front and rear surfaces of the transmitting antenna, on a side of the rear surface where an observation target is not present, to receive a reflected wave of the radio wave reflected back by the observation target, wherein one or more transmitting element antennas in the transmitting antenna are arranged side by side on a straight line, and out of a plurality of receiving element antennas in the receiving antenna, with respect to one receiving element antenna as a center, remaining receiving element antennas are symmetrically arranged, and with distance from the one receiving element antenna, each of the remaining receiving element antennas is arranged to have a longer distance to a position orthogonal to the straight line passing through a position at which each of the one or more transmitting element antennas is arranged.

2. The antenna device according to claim 1, comprising: a phase setting unit to set phases of the plurality of receiving element antennas so that, when it is assumed that the plurality of receiving element antennas is arranged on a straight line, the straight line passing through a position at which the one receiving element antenna is arranged and being parallel to the transmitting antenna, a same phase as a phase set for each of the plurality of receiving element antennas appears on the parallel straight line.

3. The antenna device according to claim 1, wherein the one receiving element antenna is arranged so that a distance to a position orthogonal to the straight line passing through the position at which each of the one or more transmitting element antennas is arranged is a length of one-quarter of a wavelength of the radio wave.

4. The antenna device according to claim 1, wherein the number of the transmitting element antennas is smaller than the number of the receiving element antennas.

5. The antenna device according to claim 1, wherein the number of the transmitting element antennas is one.

6. The antenna device according to claim 1, comprising: a switching device to connect the plurality of receiving element antennas to respective terminators in a period in which a radio wave is emitted from the one or more transmitting element antennas, and connect the one or more transmitting element antennas to a terminator in a period in which reflected waves are received by the plurality of receiving element antennas.

7. The antenna device according to claim 6, comprising:

a signal generator to generate a pulse signal as the radio wave emitted from the transmitting antenna and output the pulse signal; and a switch controlling unit to, in a period in which a pulse signal is output from the signal generator, output to the switching device, a control signal indicating that the pulse signal is output to the one or more transmitting element antennas and that the plurality of receiving element antennas is connected to the respective terminators, and in a period in which a pulse signal is not output from the signal generator, output to the switching device, a control signal indicating that the reflected waves received by the plurality of receiving element antennas are passed through and that the one or more transmitting element antennas are connected to the terminator.

8. The antenna device according to claim 2, comprising:

a phase controlling unit to adjust, for a plurality of reflected waves received by the respective plurality of receiving element antennas, a phase of each of the plurality of reflected waves to a corresponding one of the phases set by the phase setting unit; and a first beam forming circuit to form a beam by combining the plurality of reflected waves after phase adjustment by the phase controlling unit.

9. The antenna device according to claim 8, wherein the plurality of receiving element antennas is arranged at respective positions not overlapping with a direction of the beam formed by the first beam forming circuit.

10. The antenna device according to claim 2, comprising:

a plurality of analog-digital converters to convert respective reflected waves received by the plurality of receiving element antennas from analog signals to a plurality of digital signals; and a second beam forming circuit including the phase setting unit, to adjust a phase of each of the plurality of digital signals converted by the plurality of analog-digital converters to a corresponding one of the phases set by the phase setting unit, and form a beam by combining the plurality of digital signals after phase adjustment.

11. The antenna device according to claim 10, wherein the plurality of receiving element antennas is arranged at respective positions not overlapping with a direction of the beam formed by the second beam forming circuit.

12. The antenna device according to claim 1, wherein the transmitting element antennas and the receiving element antennas are dipole antennas.

13. The antenna device according to claim 1, wherein the transmitting element antennas and the receiving element antennas are monopole antennas.

* * * * *